United States Patent [19]

Martin

[11] 4,287,395

[45] Sep. 1, 1981

[54] TIMER WITH REVERSIBLE MOTOR

[76] Inventor: Ernest N. Martin, 1027 E. 5th Ave., Escondido, Calif. 92025

[21] Appl. No.: 29,621

[22] Filed: Apr. 13, 1979

[51] Int. Cl.[3] ..... H01H 43/00

[52] U.S. Cl. ..... 200/33 R; 200/37 A; 307/141; 318/282

[58] Field of Search ..... 318/282, 265, 266, 466, 318/468; 200/35 R, 38 A, 38 F, 37 R, 33 R; 307/141

[56] References Cited

U.S. PATENT DOCUMENTS 3,087,103 4/1963 Swenson ..... 318/739 X

*Primary Examiner*—J. V. Truhe
*Assistant Examiner*—Morris Ginsburg
*Attorney, Agent, or Firm*—Georges A. Maxwell

[57] ABSTRACT

A timer comprising a non-directional synchronous clock motor, an operating arm projecting radially from the motor shaft, a motor control switch controlling power supplied to the motor and engaged and opened by the arm when said arm is in a normal position, stop means spaced radially from the shaft and circumferentially from the control switch to limit turning of the arm in a direction away from the control switch and to cause the motor to rotate in the opposite direction and the arm to turn back to said normal position, a service switch in a power line to related timed means and positioned relative to the control switch, stop means and arm to be engaged and operated by the arm when said arm is in a predetermined position within its travel between said control switch and stop means and starter means connected with said power supply to energize the motor and initiate turning of the arm away from said normal position.

6 Claims, 8 Drawing Figures

Fig. 1.
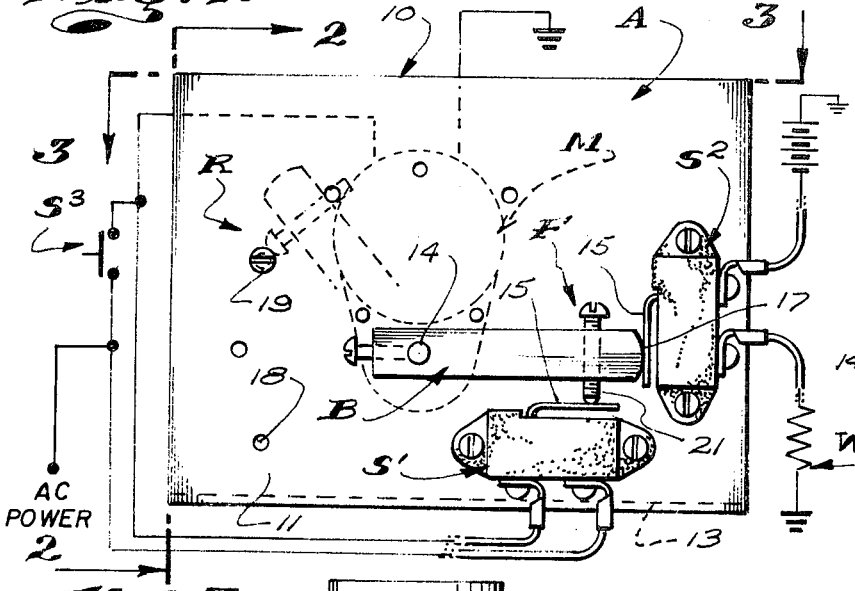
Fig. 2.
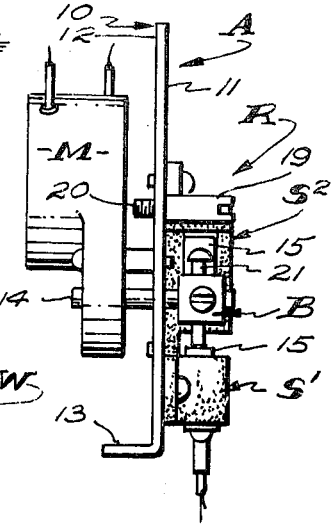
Fig. 3.
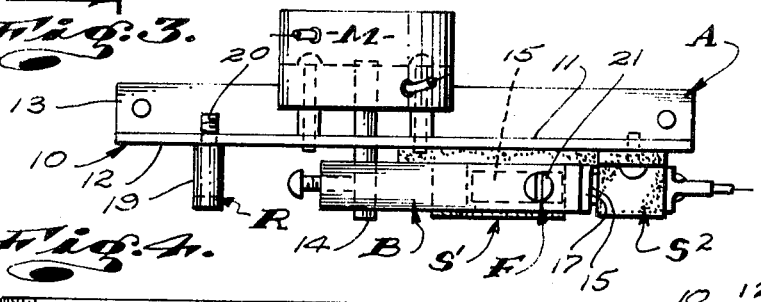
Fig. 5.
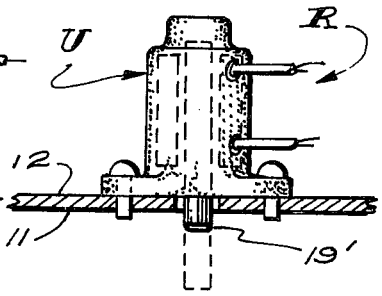
Fig. 4.
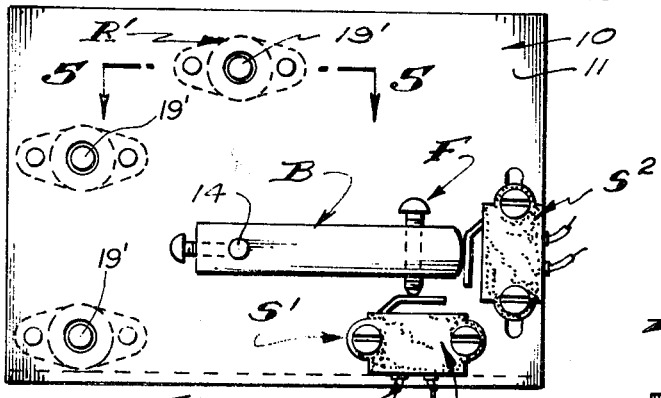
Fig. 7.
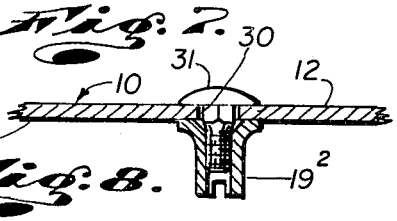
Fig. 8.
Fig. 6.
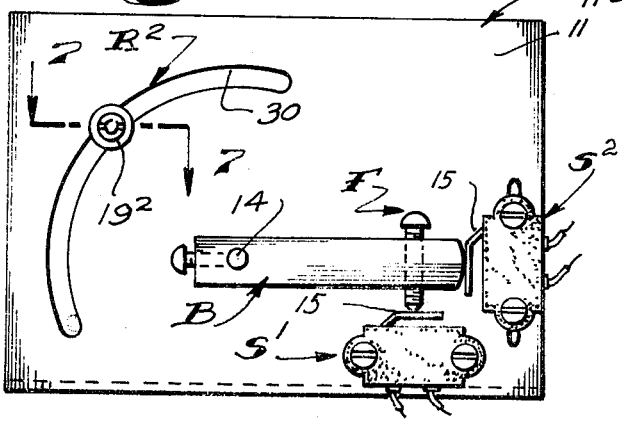
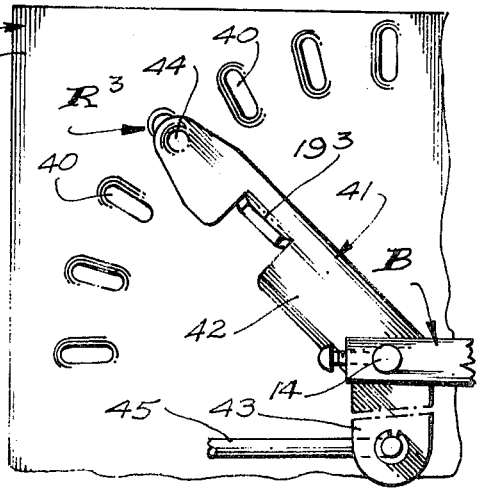

TIMER WITH REVERSIBLE MOTOR

This invention has to do with a timer and is more particularly concerned with a novel timer means for switch controlled electrically operated apparatus such as vending machines and the like.

It is an object and feature of my invention to provide an improved, novel timer means for use in a large number of those situations or installations where clock motor timing units are employed to effect the opening and closing of switches in the control means for intermittently operated or cycled electrically powered apparatus.

In various arts, it is not uncommon to intermittently or cyclically operate certain apparatus in some predetermined timed manner and to provide clock motors in the control means for such apparatus, which motors effect the opening and closing of switching means in accordance with the programmed timing procedures or sequential operation of the apparatus. Further, it is not uncommon that the clock motors in such apparatus or apparatus control means have mechanical means related thereto and/or driven thereby which, in addition to effecting the operation of related control switches, afford for the effective adjusting and setting of the time periods through which the timers are operative.

The most common form of clock motor driven mechanical means in timers of the character referred to above comprise cams on clock motor driven cam shafts, which cams are adapted to open and/or close related control switches when the shafts are driven by the clock motors. As a general rule, the positions of the cams can be varied or adjusted on the shafts to adjust the timing periods which they control. In many situations, adjustment of timing periods in or with such timing means requires substitution of cams of varying configuration, the utilization of related pairs of cams and switches.

Many common clock motor driven, control switch operating timer means provided by the prior art provide no means for time adjustment and are such that when such adjustment is required, a new or different clock motor with a different or desired operating speed is substituted for the previously used motor.

In still other clock motor driven timing means of the general character here concerned with, adjustable, variable speed, motors are employed. At other times and in some circumstances, a plurality of individual timer means, each with a different operating time period, are provided and are selectively put into service to effect desired changes in timing.

In the case of the aforementioned timer comprising clock motor driven switch operating cams or the like, the structures are complicated and costly to make and are complicated, difficult and time-consuming to adjust.

In those cases where variable speed clock; motors are provided, cost of the motors and the controls therefor are generally excessive.

In those cases where motors are exchanged to effect time adjustment, the costs and time required to effect adjustments is oftentimes excessive.

In the case of multiple timers with selective controls, the costs and the space required is oftentimes excessive.

It is an object and feature of my invention to provide small, simple and effective clock motor driving timer of the general character here concerned with which is such that its operating time cycle or period can be easily, quckly and accurately varied, adjusted and set by any person of ordinary skill and without the need of special tools or the need to rebuild or modify the structure provided.

It is another object of my invention to provide an adjustable timer of the character referred to above which is such that it can be manufactured, installed and maintained at a small fraction of the cost of most adjustable timers provided by the prior art which have equivalent capabiliities, whereby an adjustable timer can be provided in a great number of situations where the costs of manufacture, installation and maintenance have prevented or made impractical the provision and use of those adjustable timing means provided by the prior art and where non-adjustable timing means have heretofore been used.

Still another object and feature of my invention is to provide a timer of the character referred to which is such that it can be made smaller, lighter and more compact than most adjustable timers of like or equal capacity or capability, provided by the prior art and, as a general rule, can be made as small, light and compact as those non-adjustable, clock motor driven timers that are provided by the prior art, whereby my new timer can be effectively cooperatively related to most existing apparatus in which timers of a similar nature are presently used, without making extensive and/or costly modifications of the existing apparatus.

It is an object and feature of my invention to provide a timer of the general character referred to above including an inexpensive gear reduced, repulsion induction shaded pole clock motor, a switch actuating arm driven by the motor, switches arranged in arm-contacting position relative to the circumferential sweep or path of the arm and circumferentially shiftable arm engaging stop means in the sweep or path of the arm, said stop means being adjustable to vary the circumferential sweep of the arm in two directions in a segment within one revolution of said arm and to thereby change and adjust the time period of travel of said arm.

The foregoing and other objects and features of my invention will be fully understood from the following detailed description of typical preferred forms of my invention, throughout which description reference is made to the accompanying drawings, in which:

FIG. 1 is a front view of a preferred form of my invention;

FIG. 2 is a view taken as indicated by line 2—2 on FIG. 1;

FIG. 3 is a view taken as indicated by line 3—3 on FIG. 1;

FIG. 4 is a view of another form of my invention;

FIG. 5 is a view taken as indicated by line 5—5 on FIG. 4;

FIG. 6 is a view of yet another form of my invention;

FIG. 7 is a view taken as indicated by line 7—7 on FIG. 6; and

FIG. 8 is a view of still another form of the invention.

Referring to the drawings, I have illustrated that form of the present invention which has been reduced to practice and has been put into effective and satisfactory use.

The invention or timer A includes a chassis 10 which, for the purpose of this disclosure, is shown in the form of a flat, rectangular, vertical plate with front and rear surfaces 11 and 12 and which is provided with a horizontal, apertured mounting flange 13 at its lower edge.

The timer A next includes a self-reversing clock motor M mounted on the rear surface 12 of the chassis 10 and having drive shaft 14 projecting freely forwardly through an aperture in the chassis and from the front surface 11 of the chassis. The motor M is a repulsion induction, shaded pole, non-directional synchronous motor is such that when it is energized to turn will run, turn or rotate in that direction in which it is free to run and which will, when its shaft is stopped or braked from running in that one direction, automatically reverse its direction of rotation and turn in the other direction until its shaft is again stopped or braked.

In light of the above, for the purpose of this disclosure, the motor M can and will be referred to as an automatic reversing clock motor.

The motor M that I am presently using is a Model G clock motor, produced by Bowman Electric Products Corporation of Chicago, Ill. This motor is synchronously wound and is rated at 120 volts AC, 60 cycles, 3 watts. It is a gear reduced unit, the drive shaft of which rotates at 16 RPM.

Being a synchronously wound motor, the motor M is inexpensive, has few running parts, produces no undesirable high frequency interference and is a quiet operating unit. Further, since it does not have brushes which arc, it does not generate ozone gas as do more commonly used universally wound clock motors, which gas is extremely undesirable in many circumstances. For example, it has been found that in the case of food or beverage vending machines in which ozone generating universally wound clock motors are employed in the timing means for the machines, the order of the ozone generated oftentimes becomes so overpowering and odious that it adversely affects the appetites and taste sense of persons in the area. Further, and of equal significance, is the fact that ozone is a strong oxidizer, the presence of which about food stuff rapidly oxidizer the food stuff and adversely affects its taste and keeping qualities.

Since the use to which I have put my new timer is the timing of food or beverage vending machines, the above is an important and highly advantageous feature of the invention.

The timer A next includes a pair of normally open switches $S^1$ and $S^2$ mounted on the front surface 11 of the chasis in predetermined radial and circumferential spaced relationship about the shaft 14 of the motor M.

The switches $S^1$ and $S^2$ can vary widely in form and can be normally open or normally closed switches, as desired, or as circumstances require. Each is characterized by an exposed manually or mechanically engageable operating trigger 15 which, when engaged, and moved or depressed, serves to operate the switch from its normal position to its actuated position.

In the case illustrated and for the purpose of this disclosure, the switches $S^1$ and $S^2$ will be considered and described as normally closed switches.

The manually closed switch $S^1$ is engaged in one leg of the power supply to the motor M and is such that when it is actuated, the power supply to the motor M opens.

In practice, and as shown, a starter switch $S^3$ is provided in the power supply for the motor M which switch is shown connected with the same leg of the motor as is the switch $S^1$. The switch $S^3$ is a normally open switch and can be of any desired form and can be related and responsive to any suitable operating and/or control means of the apparatus or system with which the timer A is related. For example, in the case of a coin-operated vending machine, the switch $S^3$ can be related to the coin receiving mechanism or can be in the nature of a manually operable selector switch of the machine and such that when actuated, it serves a function or functions in addition to the motor starting function here concerned with.

The switch $S^2$ is a service switch which is adapted to be actuated in the timer A to effect that timed event or operation which is under control of the timer. In the case illustrated, the switch $S^2$ is normally closed and is shown engaged in a power line in which a resistance W is engaged. The resistance W can be a motor, a relay or any other electrical component, the operation or energizing of which is to be controlled by the timer A.

The timer A that I provide next includes an elongate operating arm B with an inner end drivingly coupled or connected with the front end portion of the motor shaft 14 to project radially outwardly from the shaft on a plane parallel with and spaced forward and clear of the front surface 11 of the chassis 10.

The other outer end or outer end portion of the arm B and the switches $S^1$ and $S^2$ are related so that the said outer end portion of the arm, when occurring in a normal position, engages and holds the switches $S^1$ and $S^2$ in their actuated positions, that is, it engages and holds the switches $S^1$ and $S^2$ open.

The switch $S^1$ is arranged or disposed in the arcuate path or sweep of the arm B with its operating trigger 15 disposed toward or opposing a side of the arm and such that the switch $S^1$ serves as a stop, stopping the arm in its normal, switch engaging position.

In the case illustrated, the switch $S^1$ is arranged so that its trigger 15 opposes the leading side of the arm B when the arm is rotated clockwise.

The switch $S^1$ is shown positioned radially outward from the outer end of the arm B when the arm B is in its normal or stopped position and so that the trigger 15 of the switch $S^1$ is engaged by the outer end of the arm. In practice, the outer end of the arm is radiused to establish a cam face 17 to engage the trigger 15 of the switch $S^2$, as clearly illustrated in FIG. 1 of the drawings.

Finally, my new timer includes stop means R spaced circumferentially in a counter-clockwise direction from the switch $S^1$, in the path of the arm B and which is adapted to stop counter-clockwise movement of the arm B at selected points or locations spaced circumferentially from the switch $S^1$ and about the axis of the shaft 14.

In the form of the invention shown in FIGS. 1 thorugh 3 of the drawings, the stop means R includes a plurality of circumferentially spaced threaded apertures 18 in the chassis 10, about the axis of the shaft 14 and an elongate stop post 19 with a threaded stem 20 selectively engageable in the apertures 18 whereby the post projects forwardly from the front surface 11 of the chassis and into the path of the arm B, in advance of the arm when the arm is rotated counter-clockwise.

With the means R here provided, it will be apparent that when the motor M is energized and operates to turn the arm B counter-clockwise from the normal position, the arm will turn counter-clockwise until it engages and is stopped by the post 19. When the arm engages and is stopped by the post 19, the motor immediately reverses and rotates or turns the arm B back, in a clockwise direction, toward its normal switch actuating or engaging position.

The time interval between de-actuation or closing of the normally open switch $S^1$ and $S^2$ and reactuation or opening of those switches is the time it takes for the arm, driven by the motor M, to rotate or swing from its normal position to stopped engagement with the post 19 of the stop means R and then back to its normal position.

It will be apparent that by selectively engaging the stop post in different apertures 18 in the chassis, the time interval afforded by the timer A can be effectively and accurately varied and adjusted or set as desired and as circumstances require.

It will be further apparent that adjusting and setting of time is effected by the simple and trouble-free operation of moving the stop post from engagement in one to another preferred aperture 18.

In the case illustrated, the sweep of the arm is approximately 180° and is such that the effective sweep, that is, the travel of the arm is about 360°. In practice, by appropriately positioning the switches $S^1$ and $S^2$, the sweep can be extended to about 350° with an effective travel of about 700°, or near two revolutions of the arm. Such a capability is highly desirable, and extends the potential operating range of the timer to nearly twice that of timers wherein the effective range is necessarily less than one revolution of a clock motor shaft.

In addition to the foregoing, and as shown in the drawings, the timer A includes fine adjusting or setting means F to effect opening and closing of the switch $S^2$ synchronously with opening and closing of switch $S^1$ or to delay closing and advance opening of switch $S^1$. The means F includes a setting screw 21 threadedly engaged through the outer end portion of the arm B to project from the opposite (leading and/or trailing) sides thereof. The opposite ends of the setting screw serve to engage the trigger 15 of switch $S^1$ and post 19 of the means R which they oppose, in advance and instead of actual engagement of the arm on or with the said trigger and post. The length of the set screw being fixed, it does not affect or vary the travel or sweep of the arm. However, by advancing the screw 21 one direction or the other, through the arm, the circumferential location of the outer end or cam face 17 of the arm is shifted and actuation of the switch $S^2$ is varied or adjusted with respect to acutation of the switch $S^1$.

In practice, the adjustment of time afforded by the means F can be preferably such that the adjusting of the time to time intervals between the changes afforded by the means R can be effected.

In operation, the switches are normally held actuated or open by the arm B and the timer is at rest. Upon closing of the switch $S^3$, the motor is energized and, since the arm is stopped against clockwise rotation by the switch $S^1$, drives the arm counter-clockwise closing switches $S^1$ and $S^2$. The switch $S^3$ can then be let to open. The arm B moves into stopped engagement with the post 19 of the means R and immediately reverses direction and moves back to engage and open switch $S^2$ (within a set timed interval) and to engage, open and stop against switch $S^1$, completing its cycle of operation and setting itself for recyclings.

In the form of the invention shown in FIGS. 4 and 5, the same basic structures as provided in the first form of the invention is provided, with the exception of the stop means $R^1$. The stop means $R^1$ includes a plurality of radially and circumferentially spaced solenoid units U about the axis of the shaft 14. The units U are mounted on the rear surface 12 of the chassis 10 and carry stop post $\mathbf{19^1}$ on their cases, for front and rear shifting. The posts $\mathbf{19^1}$ project forwardly through openings in the chassis 10, are normally in a rear position where they are clear of the arm B and are selectively energizable to shift the posts $\mathbf{19^1}$ forward into stopping position in the path of the arm B.

Each of the units U is under control of a suitable selector switching means (not shown) whereby any one of the several time periods afforded by the means $R^1$ can be selected, each time the timer is cycled.

In FIGS. 6 and 7, I have shown another form of stop means $R^2$. In this form of the invention, the means $R^2$ comprises an arcuate slot 30 in the chassis 10 about the shaft 14, a stop post $\mathbf{19^2}$ overlying a portion of the slot at the front surface 11 thereof, to project forwardly therefrom and a headed clamp screw 31 with its head engaging the rear surface 12 of the chassis and its shank projecting through the slot and into the post.

With the means $R^2$ illustrated and disclosed above, it will be apparent that the stop post $\mathbf{19^2}$ is capable of infinite adjustment circumferentially of the slot 30.

In the form of the invention now under consideration, the switches $S^1$ and $S^2$ could be mounted on the rear surface 12 of the chassis and the triggers 15 thereof could be provided with portions or extensions to project forwardly through an aperture or apertures in the chassis and into arm engaging position forward of the chassis without departing from the spirit of my invention.

In all other respects, the timer structure related to the means $R^2$ is essentially the same as the other forms of the invention.

In FIG. 8 of the drawings, I have shown the same basic timer structure as is provided in each form of the invention described above, but with still another form of stop means $R^3$. The means $R^3$ includes a plurality of circumferentially and radially spaced forwardly opening detents 40 in the front surface 11 of the chassis 10, about the shaft 14. A bell crank 41 is rotatably supported about the shaft 14 as by means of a suitable annular bearing about the shaft (not shown). The crank 41 has one arm 42 projecting radially across the surface 11 to the detented area of the chassis and an arm 43 projecting radially outwardly or downwardly and away from the chassis. The arm 42 has a forwardly projecting stop post $\mathbf{19^3}$ formed therein to engage and stop the arm B of the timer and has a rearwardly projecting detent engaging projection 44 formed in the outer end.

The arm 43 of the crank 41 is adapted to pivot or swing the arm 42 into projection and detent engaging alignment with a selected detent 40. The arm 43 can, for example, be connected with a suitable manually operable time selector means (not shown) by a suitable link 45.

It will be noted that with the means R and $R^2$ shown in FIGS. 1 and 6 of the drawings, the timer is capable of being adjusted and set to any desired single time period whereas in the case of the means $R^1$ and $R^3$ the timer is capable of being set to any one of a plurality of different fixed time periods, upon each cycling of the structures.

Having described only one typical preferred form and application of my invention, I do not wish to be limited or restricted to the specific details herein set forth, but wish to reserve to myself any modifications and/or variations that may appear to those skilled in the art to which this invention pertains.

Having described my invention, I claim:

1. A timer means comprising reversible repulsion inductive, shaded pole non-directional synchronous clock motor with a drive shaft and connected with an alternating current power supply, an elongate operating arm with an inner end secured to the drive shaft and projecting radially therefrom, a normally closed clock motor control switch controlling the flow of current between the motor and the power supply and arranged in fixed radial spaced relationship from the shaft and engaged and opened by the arm when said arm is in a normal rotative position to de-energize the motor, stop means spaced circumferentially from the control switch to stop turning of the arm by the motor in a direction away from the control switch when the arm reaches a predetermined rotated position and to cause the motor to reverse and rotate in the opposite direction amd move the arm back to said normal position, a service switch in a power line controlling operation of a means controlled by the timer means and positioned relative to the control switch, stop means and arm to be engaged and operated by the arm when said arm is in a predetermined position within its travel between said control switch and stop means and starter means including a normally open switch connected with and between said alternating current power supply and said motor to selectively energize the motor and initiate turning of the arm away from said normal position and out of engagement with the control switch.

2. A timer as set forth in claim 1 wherein said stop means is operable to engage and stop the arm at selected points spaced circumferentially from the control switch whereby the time period of swinging of the arm from and to its normal position can be adjusted.

3. A timer as set forth in claim 2 wherein the stop means includes a chassis on a radial plane normal to the axis of the shaft, a plurality of circumferentially spaced openings in the chassis about the axis of the shaft and a stop post selectively engageable in said openings to project from the chassis into the path of the arm.

4. A timer as set forth in claim 2 wherein said stop means includes a chassis on a radial plane normal to the axis of the shaft, an elongate arcuate slot in the chassis extending circumferentially about the axis of the shaft and relative to the control switch, an elongate stop post engaged within said slot to project from the chassis and shiftable longitudinally of the slot thereof and projecting therefrom into the path of the arm and clamp means related to the post and the chassis and operable to releasably hold the post in selected positions longitudinally of the slot.

5. A timer as set forth in claim 2 wherein the stop means includes a plurality of electro magnetic drive units arranged in predetermined radial and circumferential spaced relationship about the shaft, a stop post drivingly carried by each drive unit, and switch controlled power suplied connected with the drive units, said drive units operable to move the posts into and out of arm engaging and stopping position in the path of the said arm.

6. A timer as set forth in claim 2 wherein said stop means includes an elongate stop beam with one end pivotally supported on an axis common with the shaft and on a plane adjacent to and parallel with the plane of the arm, a stop post projecting from the beam and into the path of the arm and indexing means related to the beam to selectively position the beam in fixed rotative positions.

* * * * *